US012168465B2

(12) United States Patent
Song et al.

(10) Patent No.: US 12,168,465 B2
(45) Date of Patent: Dec. 17, 2024

(54) GEARBOX FOR RAIL VEHICLE, BOGIE FOR RAIL VEHICLE AND RAIL VEHICLE

(71) Applicant: CRRC QINGDAO SIFANG CO., LTD., Qingdao (CN)

(72) Inventors: Shuliang Song, Qingdao (CN); Zhen Chang, Qingdao (CN); Yuejun Zhang, Qingdao (CN); Jinming Zhou, Qingdao (CN); Tianyi Li, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 674 days.

(21) Appl. No.: 17/610,679

(22) PCT Filed: May 18, 2020

(86) PCT No.: PCT/CN2020/090833

§ 371 (c)(1),
(2) Date: Nov. 11, 2021

(87) PCT Pub. No.: WO2020/238679

PCT Pub. Date: Dec. 3, 2020

(65) Prior Publication Data

US 2022/0212697 A1 Jul. 7, 2022

(30) Foreign Application Priority Data

May 30, 2019 (CN) ..... 201910463546.3

(51) Int. Cl.
*B61C 9/50* (2006.01)
*B61C 9/38* (2006.01)
(Continued)

(52) U.S. Cl.
CPC ..... *B61C 9/50* (2013.01); *B61C 9/38* (2013.01); *B61F 3/04* (2013.01); *B61F 5/52* (2013.01)

(58) Field of Classification Search
CPC ..... B61F 5/52; B61F 3/04; B61F 5/04; B61C 9/38; B61C 9/50; B61C 9/48; B61B 13/04
See application file for complete search history.

(56) References Cited

U.S. PATENT DOCUMENTS 1,776,480 A * 9/1930 Rayburn ..... B61C 5/00 105/62.1
2,715,876 A * 8/1955 Schneider ..... B61C 9/10 105/97
(Continued)

FOREIGN PATENT DOCUMENTS

CN 105416331 A 3/2016
CN 105774834 A * 7/2016
(Continued)

OTHER PUBLICATIONS

The International Search Report of the International Searching Authority for PCT Application No. PCT/CN2020/090833 mailed Aug. 14, 2020, 6 pages.
(Continued)

*Primary Examiner* — Zachary L Kuhfuss
*Assistant Examiner* — Cheng Lin
(74) *Attorney, Agent, or Firm* — Womble Bond Dickinson (US) LLP

(57) ABSTRACT

Disclosed is a gearbox for rail vehicle, a bogie for rail vehicle and a rail vehicle. The gearbox for rail vehicle includes a primary gearbox (1) configured to connect with a traction motor, and a secondary gearbox (2) arranged on both sides of the primary gearbox (1) along a longitudinal direction of the rail vehicle, wherein a framework bearing beam is formed by connecting the primary gearbox (1) and the secondary gearbox (2), the primary gearbox (1) is configured to transmit power from the traction motor to the secondary gearbox (2), and the secondary gearbox (2) are
(Continued)

configured to transmit power from the primary gearbox (1) to wheelsets of the rail vehicle.

20 Claims, 2 Drawing Sheets

(51) Int. Cl.
*B61F 3/04* (2006.01)
*B61F 5/52* (2006.01)

(56) References Cited

U.S. PATENT DOCUMENTS 3,513,782 A * 5/1970 Lich ..... B61F 3/04 105/139
3,576,166 A * 4/1971 Bollmann ..... B61C 9/14 105/199.1
3,919,948 A * 11/1975 Kademann ..... B61C 9/14 105/108
10,167,002 B2 * 1/2019 Chen ..... B61C 9/48
11,208,123 B2 * 12/2021 Zhang ..... B61F 5/52
11,731,669 B2 * 8/2023 Kounoike ..... B61F 5/48 105/182.1
2022/0212696 A1 * 7/2022 Zhao ..... B61F 5/52

FOREIGN PATENT DOCUMENTS

CN 106541823 A 3/2017
CN 107128321 A * 9/2017
CN 107499328 A 12/2017
CN 110155087 A 8/2019
GB 860178 A 2/1961
KR 20120093015 A * 8/2012

OTHER PUBLICATIONS

The Written Opinion of the International Searching Authority for PCT Application No. PCT/CN2020/090833 mailed Aug. 14, 2020, 5 pages.
The International Preliminary Report on Patentability of the Patent Cooperation Treaty for PCT Application No. PCT/CN2020/090833 issued Dec. 7, 2021, 6 pages.

* cited by examiner

GEARBOX FOR RAIL VEHICLE, BOGIE FOR RAIL VEHICLE AND RAIL VEHICLE

CROSS-REFERENCE TO RELATED APPLICATIONS

The present application is a U.S. National Phase Application under 35 U.S.C. § 371 of International Application No. PCT/CN2020/090833, filed 18 May 2020, which claims priority to Chinese patent application No. 2019104635463 filed on May 30, 2019, entitled "Gearbox for Rail Vehicle, Bogie for Rail Vehicle and Rail Vehicle", which was incorporated by reference in its entirety.

FIELD OF TECHNOLOGY

The present application relates to the technical field of gear transmission, and in particular to a gearbox for rail vehicle, a bogie for rail vehicle and a rail vehicle.

BACKGROUND

As important parts of rail vehicles, bogie frameworks directly determine the power performance and safety performance of the rail vehicles. Therefore, how to improve the quality of bogies for rail vehicle so that the bogies may better transmit kinetic energy while manufacturing costs are decreased and installation processes are simplified is concerned about by technicians in the field nowadays.

At present, since the degree of integration of various parts of the bogies for rail vehicle is not high, the manufacturing and installation thereof are relatively time-consuming and laborious, and the strength at each position cannot be guaranteed. In particular, the installation of the gearbox is implemented by separately disposing a gearbox mounting seat on the bogie framework, which makes the installation and manufacturing process of the bogie framework complicated, and the structural strength is not high. Moreover, the obtained bogie is not highly integrated, and there are potential safety hazards in operation of trains.

In addition, taking a straddling monorail vehicle as an example, due to the additional arrangement of the gearbox relative to the bogie framework, the height of the undercarriage is excessive, that is, the height of the rail vehicle floor from the ground is over high, which affects the escape and evacuation of passengers and reduces the safety of operation. In addition, the greater height of the rail vehicle floor from the ground will weaken the driving safety and reduce the rolling resistance of the rail vehicle. Also, due to the excessive height of the entire vehicle, the rail vehicle may only run on an outdoor elevated track beam, and cannot run in the tunnel, so that many lines cannot use this kind of vehicle.

BRIEF SUMMARY

The present application is intended to address at least one of the technical problems above.

An objective of the present application is to provide a gearbox for rail vehicle, a bogie for rail vehicle, and a rail vehicle, which solves the problems of time-consuming and labor-intensive manufacturing and potential safety hazards caused by the poor integration of various parts of the bogie for rail vehicle, and the problems of safety and limited operating conditions due to the excessive height under the vehicle caused by the bogie for rail vehicle in the prior art.

In order to achieve this objective, the present application provides a gearbox for rail vehicle, including a primary gearbox configured to connect with a traction motor, and further including a secondary gearbox arranged on both sides of the primary gearbox along a longitudinal direction of the rail vehicle, wherein a framework bearing beam is formed by connecting the primary gearbox and the secondary gearbox, the primary gearbox is configured to transmit power from the traction motor to the secondary gearbox, and the secondary gearbox are configured to transmit power from the primary gearbox to wheelsets of the rail vehicle.

According to one of the embodiments of the present application, along the longitudinal direction of the rail vehicle, the secondary gearbox is gradually inclined upward toward a direction away from the primary gearbox.

According to one of the embodiments of the present application, the secondary gearbox includes a first secondary gearbox and a second secondary gearbox arranged on both sides of the primary gearbox, respectively, the first secondary gearbox is configured to transmit power from the primary gearbox to a front wheelset of the rail vehicle, and the second secondary gearbox is configured to transmit power from the primary gearbox to a rear wheelset of the rail vehicle.

According to one of the embodiments of the present application, the primary gearbox includes a primary box body including a top plate, a bottom plate, a side plate connecting the top plate and the bottom plate, and an end plate connecting the side plate, and both the side plate and the end plate are provided with avoidance holes.

According to one of the embodiments of the present application, both the side plate and the end plate extend toward an outer side of the top plate, and a mounting platform for air spring is formed between the top plate, the side plate and the end plate.

According to one of the embodiments of the present application, a mounting table is provided on a side of the top plate proximal to the mounting platform, and is configured to be connected with the secondary gearbox.

According to one of the embodiments of the present application, the secondary gearbox includes a secondary box body, and the secondary box body is divided into a left box body and a right box body by a vertical longitudinal section.

According to one of the embodiments of the present application, each of the left box body and the right box body is formed with a first connecting flange along an opening, and a second connecting flange is arranged on an end surface of the secondary box body proximal to the primary gearbox.

According to one of the embodiments of the present application, the secondary box body is provided with a support seat protruding outwards for mounting bearings of the wheelset.

According to one of the embodiments of the present application, the secondary gearbox further includes a first wheel axle and a second wheel axle for connecting traveling wheels on different sides of the wheelset, and both the first wheel axle and the second wheel axle extend out of the secondary box body from the support seat, and an end of the first wheel axle and an end of the second wheel axle both located inside the secondary box body are connected by a differential.

According to one of the embodiments of the present application, an end of the secondary box body away from the primary gearbox is formed with a plug joint for connecting with an end beam of the framework.

In order to achieve this objective, the present application provides a bogie for rail vehicle, including the above-mentioned gearbox for rail vehicle, and further including a traction motor and wheelsets, wherein the traction motor is connected to the primary gearbox, and the wheelset is connected to the secondary gearbox.

According to one of the embodiments of the present application, the bogie for rail vehicle further includes an end beam, which is connected to an end of the secondary gearbox away from the primary gearbox.

In order to achieve this objective, the present application provides a rail vehicle including the above-mentioned bogie for rail vehicle.

The technical solutions of the present application have the following advantages: in the gearbox for rail vehicle of the present application, the primary gearbox and the secondary gearbox are integrated on the bogie framework of the railway vehicle, thereby simplifying the overall structure of the bogie and being conducive to subsequent maintenance and repair. In addition, the bogie equipped with this kind of gearbox does not need to be separately and additionally provided with a gearbox mounting seat, thus the preparation is simple, the structural intensity is high, and there is no safety hazard during operation, which solves a series of problems caused by low integration of the bogie for rail vehicle. Further, the integrated design of the gearbox and the bogie framework and the built-in gear transmission are conducive to reducing the height of the bogie, meeting the shield requirements of suburban elevated railways, urban tunnels and A-type subway tunnels, and greatly reducing the project cost. For a rail vehicle equipped with this kind of gearbox, the height of the vehicle floor from the evacuation channel may be reduced, and the escape safety may be improved.

BRIEF DESCRIPTION OF THE DRAWINGS

In order to more clearly illustrate the technical solutions in the embodiments of the present application or the prior art, drawings needed in the descriptions of the embodiments or the prior art will be briefly introduced below. Obviously, the drawings in the following description are only some of the embodiments of the present application, and other drawings can be obtained according to these drawings without any creative effort for those skilled in the art.

REFERENCE NUMERALS

Figure 1:
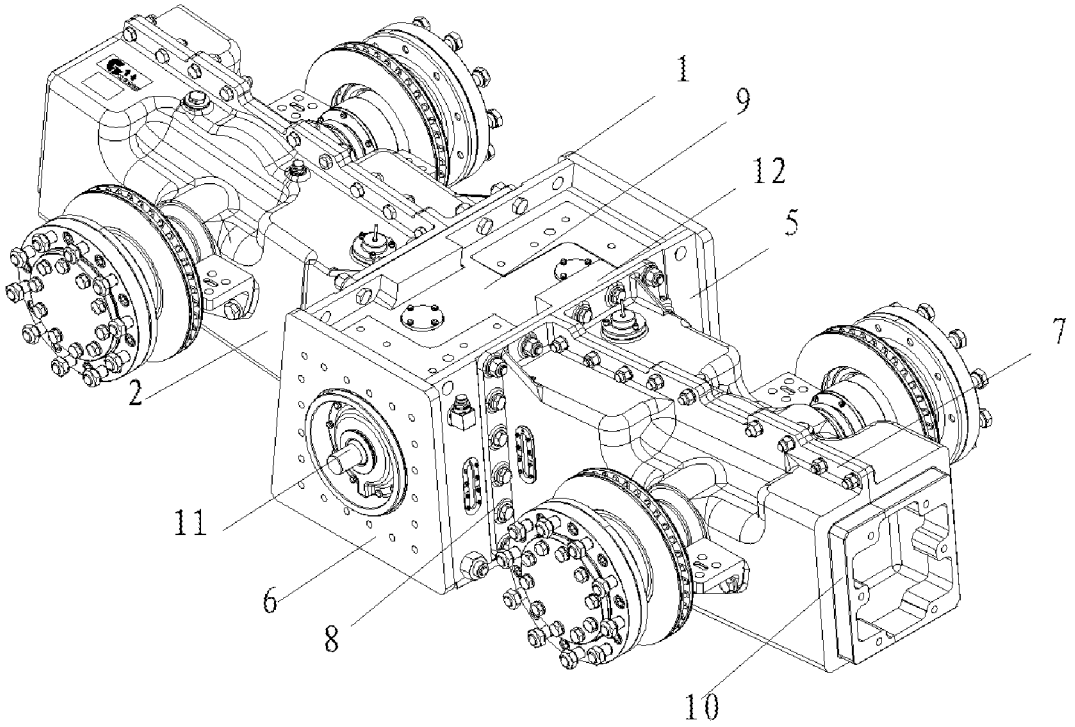
FIG. 1 is a schematic three-dimensional structural diagram of a bogie according to an embodiment of the present application.

1. primary gearbox; 2. secondary gearbox; 3. top plate; 4. bottom plate; 5. side plate; 6. end plate; 7. first connecting flange; 8. second connecting flange; 9. mounting platform; 10. plug joint; 11. input shaft; 12. mounting table.

DETAILED DESCRIPTION

The implementations of the present application are further described in detail below in conjunction with the drawings and embodiments. The following embodiments are intended to illustrate the present application, but cannot be used to limit the scope of the present application.

In the description of the present application, it is to be noted that the orientations or positional relationships indicated by terms such as "center", "longitudinal", "lateral", "upper", "lower", "front", "rear", "left", "right", "vertical", "horizontal", "top", "bottom", "inside", "outside" are based on the orientation or positional relationship shown in the drawings, and are merely for the convenience of describing the present application and simplifying the description, rather than indicating or implying that the device or component stated must have a particular orientation, is constructed and operated in a particular orientation, and thus is not to be construed as limiting the present application. Moreover, the terms "first", "second", and "third" are used for descriptive purposes only and cannot be construed as indicating or implying relative importance.

In the description of the present application, it is to be noted that unless expressly specified and defined otherwise, the terms "connected with," and "connected to" shall be understood broadly, for example, it may be either fixedly connected or detachably connected, or may be integrated; it may be mechanically connected, or electrically connected; it may be directly connected, or indirectly connected through an intermediate medium. The specific meanings of the terms above in the present application can be understood by those of ordinary skill in the art in accordance with specific conditions.

According to one of the embodiments of the present application, referring to FIG. 1, a gearbox for rail vehicle is provided, including a primary gearbox 1 configured to connect with a traction motor, and further including a secondary gearbox 2 arranged on both sides of the primary gearbox 1 along a longitudinal direction of the rail vehicle, wherein a framework bearing beam is formed by connecting the primary gearbox 1 and the secondary gearbox 2, the primary gearbox 1 is configured to transmit power from the traction motor to the secondary gearbox 2, and the secondary gearbox 2 are configured to transmit power from the primary gearbox 1 to wheelsets of the rail vehicle.

In the gearbox for rail vehicle, the primary gearbox 1 and the secondary gearbox 2 are integrated on the bogie framework of the railway vehicle, thereby simplifying the overall structure of the bogie and facilitating subsequent maintenance and repair. In addition, the bogie equipped with this kind of gearbox does not need to be separately and additionally provided with a gearbox mounting seat, such that the preparation is simple, the structural intensity is high, and there is no safety hazard during operation, which solves a series of problems caused by low integration of the bogie for rail vehicle in the prior art. Further, the integrated design of the gearbox (without additional limitation, the gearbox mentioned in the present application refers to the primary gearbox 1 and the secondary gearbox 2) and the bogie framework and the built-in gear transmission are conducive to reducing the height of the bogie, meeting the shield requirements of suburban elevated railways, urban tunnels and A-type subway tunnels, and greatly reducing the project cost. For a rail vehicle equipped with this kind of gearbox, the height of the vehicle floor from the evacuation channel may be reduced, and the escape safety may be improved.

It is worth mentioning that because this kind of gearbox integrates the gear transmission function and the framework bearing function, the manufacturing cost of the bogie may be saved, and the power transmission structural distribution of the wheelset of the rail vehicle is more reasonable.

Figure 2:
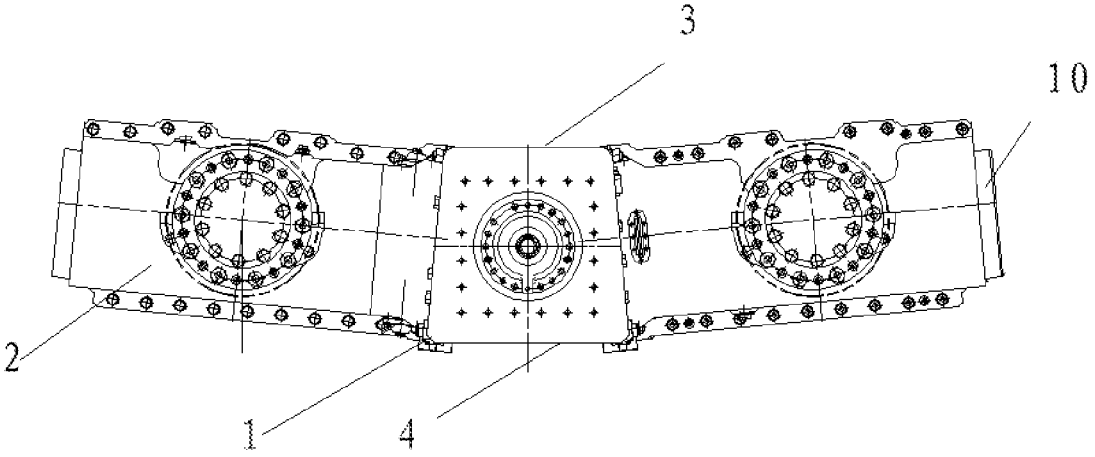
FIG. 2 is a schematic structural side view of a bogie according to an embodiment of the present application.

Referring to FIG. 2, along the longitudinal direction of the rail vehicle, the secondary gearbox 2 is gradually inclined upward toward the direction away from the primary gearbox 1. That is, in FIG. 2, the framework bearing beam formed by the gearbox is recessed downward at the position of the primary gearbox 1. Air springs are carried above the primary gearbox 1, a vehicle body of the rail vehicle is carried above the air springs, and a wheel diameter of the traveling wheel is fixed. By making a recess at the primary gearbox 1, the overall height of the rail vehicle may be decreased, thereby improving the running stability of the rail vehicle and ensuring the safety during escape. That is, when other components of the rail vehicle are of inconvenient specifications, the overall height of the rail vehicle can be reduced by designing the gearbox of the rail vehicle into a form that the primary gearbox 1 is relatively concave.

The secondary gearbox 2 includes a first secondary gearbox and a second secondary gearbox arranged on both sides of the primary gearbox 1. In an embodiment, the first secondary gearbox is configured to transmit power from the primary gearbox 1 to a front wheelset of the rail vehicle, and the second secondary gearbox is configured to transmit power from the primary gearbox 1 to a rear wheelset of the rail vehicle.

When the first and second secondary gearboxes have the same structure, it is possible but not necessary to symmetrically arrange the first and second secondary gearboxes on both sides of the primary gearbox 1.

According to one of the embodiments of the present application, the primary gearbox 1 includes a primary box body including a top plate 3, a bottom plate 4, a side plate 5 connecting the top plate 3 and the bottom plate 4, and an end plate 6 connecting the side plate 5. Through the arrangement of the top plate 3, the bearing surface of the primary gearbox 1 may be increased, so that when the primary gearbox 1 is used as a component of the framework bearing beam, the force is more uniform, and stress concentration on the primary box body is prevented. In an embodiment, the specific structural forms of the top plate 3, the bottom plate 4, the side plates 5 and the end plates 6 are not limited, and may adopt either a flat plate structure, or a curved plate with a curvature, or a bent plate, etc. Moreover, the structure of the primary gearbox 1 is not limited by the examples here, as long as it may meet the load-bearing requirements.

In order to ensure the power transmission from the traction motor to the wheelsets, both the side plate 5 and the end plate 6 of the primary gearbox 1 are provided with avoidance holes. In an embodiment, the avoidance hole on the end plate 6 is for enabling the connection between the traction motor and a gear train inside the primary gearbox 1. Specifically, an input shaft 11 is provided at the end plate 6, and is connected to a coupling of the traction motor. The avoidance hole on the side plate 5 is for enabling the connection between the gear train inside the primary gearbox 1 and a gear train inside the secondary gearbox 2.

In FIG. 1, the side plate 5 of the primary box body refers to a plate structure connected with the secondary gearbox 2, and the end plate 6 refers to a trapezoidal plate in FIG. 1.

It is worth mentioning that in FIGS. 1 and 2, the end plate 6 is designed in the form of a trapezoidal plate, which may make the structure of the primary box body more stable, so that the force received by the top plate 3 is transferred through the side plate 5 and the end plate 6 to the bottom plate 4, thereby preventing the top plate 3 from being damaged. In addition, designing the end plate 6 in the form of a trapezoidal plate may also facilitate the installation of the secondary gearbox 2, so that the secondary gearbox 2 is fixed on the side plate 5 while the requirements of "along the longitudinal direction of the rail vehicle, the secondary gearbox 2 is gradually inclined upward toward the direction away from the primary gearbox 1" is satisfied.

Further referring to FIG. 1, both the side plate 5 and the end plate 6 extend toward an outer side of the top plate 3, and a mounting platform 9 for air spring is formed between the top plate 3, the side plate 5 and the end plate 6. The mounting platform 9 is a recessed platform formed on the top of the primary gearbox 1, which may make the installation of the air spring reliable and stable.

Figure 3:
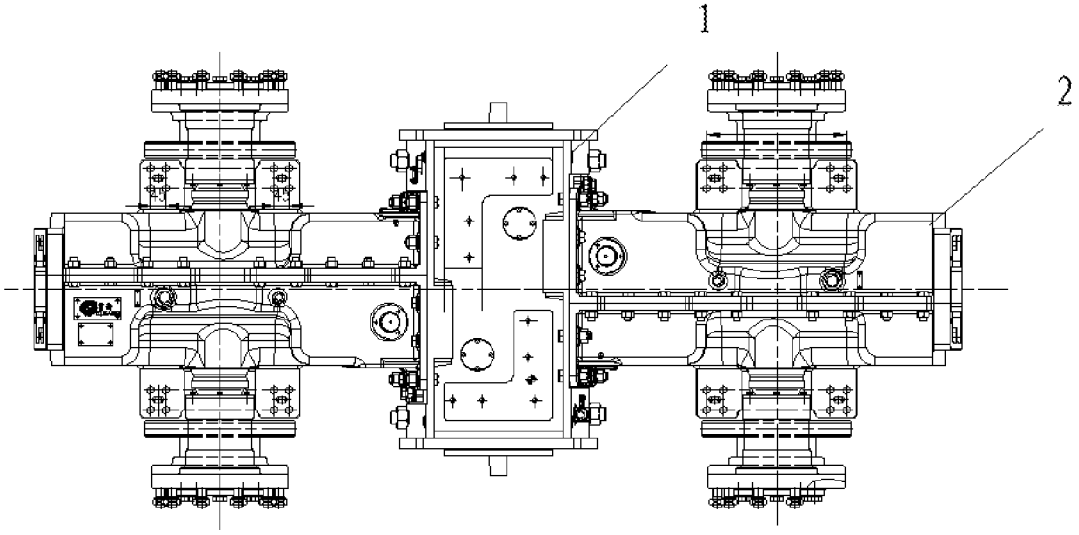
FIG. 3 is a schematic structural top view of a bogie according to an embodiment of the present application.

It is found from FIGS. 1 and 3 that a mounting table 12 is provided on a side of the top plate 3 proximal to the mounting platform 9, and is configured to be connected with the secondary gearbox 2. For example, a threaded member passes through the secondary gearbox 2 and then penetrates into the mounting table 12 to provide the fixation between the secondary gearbox 2 and the primary gearbox 1. If no mounting platform 12 is provided, the area on the primary gearbox 1 for connecting the secondary gearbox 2 may become a weak link under force of the primary gearbox 1.

Further, it is found from FIGS. 1 and 3 that the mounting platforms 9 corresponding to two side plates 5 are staggered with each other, thereby meeting the distribution requirements of other parts.

According to one of the embodiments of the present application, the secondary gearbox 2 includes a secondary box body, and the secondary box body is divided into a left box body and a right box body by a vertical longitudinal section. Separating the secondary box body into the left box body and the right box body from the vertical longitudinal section may facilitate the installation of the gear train inside the secondary box body. In order to facilitate the installation of the gear train of the secondary gearbox 2, in addition to dividing the secondary box body into multiple parts at the vertical longitudinal section, the secondary box body may also be divided from any other position.

Further, each of the left box body and the right box body is formed with a first connecting flange 7 along an opening, thereby facilitating the assembly of the left box body and the right box body. In an embodiment, the left box body and the right box body may be tightened by circumferential bolts to meet the requirement of quick installation.

According to one of the embodiments of the present application, a second connecting flange 8 is arranged on an end surface of the secondary box body proximal to the primary gearbox 1. When the primary box body is connected to the secondary box body, the second connecting flange 8 is attached to the side plate 5 of the primary box body and fixed with threaded elements, so that the second connecting flange 8 bears the shearing force generated by vibration between the primary and secondary box bodies. Further, the second connecting flange 8 increases the force-bearing area between the primary box body and the secondary box body, and at the same time may facilitate the connection of the primary box body with the secondary box body.

Further, a positioning stop port may be provided between the primary box body and the secondary box body so as to realize rapid installation between the primary box body and the secondary box body.

In addition, a plurality of bolt holes may be reserved on the surfaces of the primary box body and the secondary box body to respectively assemble a plurality of functional parts such as traction device (e.g., center traction seat), travelling system, framework mounting seat, motor mounting seat, and brake seat. In addition, two independent transmission systems may be arranged in the primary box body and secondary box body, and the two transmission systems do not interfere with each other, thereby meeting the requirements of independent transmission between the front wheelset and the rear wheelset.

According to one of the embodiments of the present application, the secondary gearbox 2 protrudes to form a support seat for connecting with bearings of the wheelset. The support seat may be configured to install the bearings and allow wheel axles to connect the wheelset after passing through the support seat.

Referring to FIG. 1 again, an end of the secondary gearbox 2 away from the primary gearbox 1 is formed with a plug joint 10 for connecting with an end beam of a framework. Through the arrangement of the plug joint 10, the assembly of the bogie framework may be facilitated, and the positioning and connection between the end beam and the gearbox-type framework bearing beam may be provided.

In order to reduce the weight of the bogie framework, a weight reduction hole is provided at the position of the plug joint 10.

According to one of the embodiments of the present application, the primary box body is processed and welded with steel plates, and has a box-shaped structure. The secondary box body is cast and has a sub-box structure. The sub-box surface is a flange surface of the second connecting flange 8.

The aforementioned gearbox for rail vehicle is classified into a primary gearbox 1 and a secondary gearbox 2, and the primary gearbox 1 and the secondary gearbox 2 are configured as the central structure of the bogie to provide installation positions for other functional parts of the bogie.

According to one of the embodiments of the present application, a differential is designed inside the gearbox, so that the travelling wheels on both sides of the wheelset may have a speed difference, thereby reducing the wear of the travelling wheels.

Specifically, each wheelset includes a first travelling wheel and a second travelling wheel. The first travelling wheel is connected to a first wheel axle, and the second travelling wheel is connected to a second wheel axle, and the first wheel axle is connected with the second wheel axle through the differential.

In an embodiment, both the first wheel axle and the second wheel axle pass through the support seat to extend out of the secondary box body.

According to one of the embodiments of the present application, a bogie for rail vehicle is provided, including the gearbox for rail vehicle, and further including a traction motor and wheelsets, wherein the traction motor is connected to the primary gearbox 1, and the wheelset is connected to the secondary gearbox 2.

In an embodiment, the traction motor includes a motor box. The motor box is arranged on both sides of the primary gearbox 1 along the transverse direction of the rail vehicle, and a cross beam of the bogie framework is formed by connecting the motor box and the primary gearbox 1. Also, a vertical beam of the bogie framework may be formed by connecting the primary gearbox 1 and the secondary gearbox 2. Further, the motor box, the primary gearbox 1 and the secondary gearbox 2 are combined to form a cross-shaped or nearly-cross-shaped box beam structure of the bogie framework.

In an embodiment, the motor box corresponds to the concept of motor body. Specifically, the motor box refers to a box structure for installing the motor body.

Further, the bogie for rail vehicle further includes end beams, which are connected to ends of the secondary gearbox 2 away from the primary gearbox 1. Further, the end beams and the above-mentioned cross-shaped or nearly-cross-shaped box beam structure are combined to obtain a double-H-shaped or nearly-double-H-shaped bogie framework.

For this kind of bogie framework of the rail vehicle, structures such as the motor mounting seat and a gearbox boom seat on the traditional bogie framework are eliminated, which improves the efficiency of disassembly and assembly of the bogie. In addition, by using this kind of bogie framework, the overall weight of the bogie may be decreased, thereby reducing the wear of the wheelsets and saving operating costs.

According to one of the embodiments of the present application, the end beam is a U-shaped beam with an opening facing downward. Specifically, the U-shaped beam includes cantilever beams and a connecting beam located between the cantilever beams on both sides. The structure of the end beam can facilitate the installation of guide wheels.

In addition, the bogie framework of the rail vehicle also includes axle boxes, and the axle box is fixed on the gearbox and is arranged between the motor box and the end beam along the longitudinal direction of the rail vehicle.

In an embodiment, a support seat is provided on the side of the gearbox, and the axle box is mounted on the support seat. Compared with the traditional axle box located at the bottom of the bogie framework, the space at the bottom of the bogie framework may be saved.

The gearbox for rail vehicle and the bogie for rail vehicle mentioned above are especially suitable for straddling monorail vehicles. Although traditional straddling monorail vehicles have the characteristics of low noise, small occupied area, strong climbing capability and the like, the applicable environment is very limited due to the excessive height of the entire vehicle. By adopting the above-mentioned gearbox for rail vehicle or even the bogie for rail vehicle, the wheel track of the travelling wheels may be widened, the height of the rail vehicle may be decreased, the stability of the rail vehicle may be improved, so that the application range of the rail vehicle may be greatly increased.

According to one of the embodiments of the present application, a rail vehicle is provided, including the bogie for rail vehicle mentioned above.

The implementations above are only used to illustrate the present application, but not to limit the present application. Although the present application has been described in detail with reference to the embodiments, those of ordinary skill in the art should understand that various combinations, modifications, or equivalent substitutions of the technical solutions of the present application do not depart from the spirit and scope of the technical solutions of the present application, and should all be covered within the scope of the claims of the present application.

What is claimed is:

1. A gearbox for rail vehicle, comprising a primary gearbox configured to connect with a traction motor, and further comprising a secondary gearbox arranged on both sides of the primary gearbox along a longitudinal direction of the rail vehicle, wherein a framework bearing beam is formed by connecting the primary gearbox and the secondary gearbox, the primary gearbox is configured to transmit power from the traction motor to the secondary gearbox, and the secondary gearbox is configured to transmit power from the primary gearbox to wheelsets of the rail vehicle.

2. The gearbox for rail vehicle of claim 1, wherein along the longitudinal direction of the rail vehicle, the secondary gearbox is gradually inclined upward toward a direction away from the primary gearbox.

3. The gearbox for rail vehicle of claim 1, wherein the secondary gearbox comprises a first secondary gearbox and a second secondary gearbox arranged on both sides of the primary gearbox, respectively, the first secondary gearbox is configured to transmit power from the primary gearbox to a front wheelset of the rail vehicle, and the second secondary gearbox is configured to transmit power from the primary gearbox to a rear wheelset of the rail vehicle.

4. The gearbox for rail vehicle of claim 1, wherein the primary gearbox comprises a primary box body including a top plate, a bottom plate, a side plate connecting the top plate and the bottom plate, and an end plate connecting the side plate, and both the side plate and the end plate are provided with avoidance holes.

5. The gearbox for rail vehicle of claim 4, wherein both the side plate and the end plate extend toward an outer side of the top plate, and a mounting platform for air spring is formed between the top plate, the side plate and the end plate.

6. The gearbox for rail vehicle of claim 5, wherein a mounting table is provided on a side of the top plate proximal to the mounting platform, and is configured to be connected with the secondary gearbox.

7. The gearbox for rail vehicle of claim 1, wherein the secondary gearbox comprises a secondary box body, and the secondary box body is divided into a left box body and a right box body by a vertical longitudinal section.

8. The gearbox for rail vehicle of claim 7, wherein each of the left box body and the right box body is formed with a first connecting flange along an opening, and a second connecting flange is arranged on an end surface of the secondary box body proximal to the primary gearbox.

9. The gearbox for rail vehicle of claim 7, wherein the secondary box body is provided with a support seat protruding outwards for mounting bearings of the wheelset.

10. The gearbox for rail vehicle of claim 9, wherein the secondary gearbox further comprises a first wheel axle and a second wheel axle for connecting traveling wheels on different sides of the wheelset, both the first wheel axle and the second wheel axle extend out of the secondary box body from the support seat, and an end of the first wheel axle and an end of the second wheel axle both located inside the secondary box body are connected by a differential.

11. The gearbox for rail vehicle of claim 7, wherein an end of the secondary box body away from the primary gearbox is formed with a plug joint for connecting with an end beam of a framework.

12. A bogie for rail vehicle, comprising a gearbox for rail vehicle, comprising a primary gearbox configured to connect with a traction motor, and further comprising a secondary gearbox arranged on both sides of the primary gearbox along a longitudinal direction of the rail vehicle, wherein a framework bearing beam is formed by connecting the primary gearbox and the secondary gearbox, the primary gearbox is configured to transmit power from the traction motor to the secondary gearbox, and the secondary gearbox is configured to transmit power from the primary gearbox to wheelsets of the rail vehicle, and further comprising a traction motor and wheelsets, wherein the traction motor is connected to the primary gearbox, and the wheelset is connected to the secondary gearbox.

13. The bogie for rail vehicle of claim 12, further comprising an end beam, and the end beam is connected to an end of the secondary gearbox away from the primary gearbox.

14. A bogie for rail vehicle of claim 12, wherein along the longitudinal direction of the rail vehicle, the secondary gearbox is gradually inclined upward toward a direction away from the primary gearbox.

15. The bogie for rail vehicle of claim 14, further comprising an end beam, and the end beam is connected to an end of the secondary gearbox away from the primary gearbox.

16. A bogie for rail vehicle of claim 12, wherein the secondary gearbox comprises a first secondary gearbox and a second secondary gearbox arranged on both sides of the primary gearbox, respectively, the first secondary gearbox is configured to transmit power from the primary gearbox to a front wheelset of the rail vehicle, and the second secondary gearbox is configured to transmit power from the primary gearbox to a rear wheelset of the rail vehicle.

17. The bogie for rail vehicle of claim 16, further comprising an end beam, and the end beam is connected to an end of the secondary gearbox away from the primary gearbox.

18. A bogie for rail vehicle of claim 12, wherein the primary gearbox comprises a primary box body including a top plate, a bottom plate, a side plate connecting the top plate and the bottom plate, and an end plate connecting the side plate, and both the side plate and the end plate are provided with avoidance holes.

19. The bogie for rail vehicle of claim 18, further comprising an end beam, and the end beam is connected to an end of the secondary gearbox away from the primary gearbox.

20. A rail vehicle, comprising a bogie for rail vehicle, comprising a primary gearbox configured to connect with a traction motor, and further comprising a secondary gearbox arranged on both sides of the primary gearbox along a longitudinal direction of the rail vehicle, wherein a framework bearing beam is formed by connecting the primary gearbox and the secondary gearbox, the primary gearbox is configured to transmit power from the traction motor to the secondary gearbox, and the secondary gearbox is configured to transmit power from the primary gearbox to wheelsets of the rail vehicle, and further comprising a traction motor and wheelsets, wherein the traction motor is connected to the primary gearbox, and the wheelset is connected to the secondary gearbox.

* * * * *